US007874408B2

(12) United States Patent
Suppancig

(10) Patent No.: US 7,874,408 B2
(45) Date of Patent: Jan. 25, 2011

(54) WORK BAG OR TRAVEL SUITCASE WITH AN INCORPORATED EXTENDABLE PULL HANDLE AND WITH WHEELS

(75) Inventor: Massimo Suppancig, Milan (IT)

(73) Assignee: Valextra S.p.A., Milan (IT)

( * ) Notice: Subject to any disclaimer, the term of this patent is extended or adjusted under 35 U.S.C. 154(b) by 452 days.

(21) Appl. No.: 11/914,373

(22) PCT Filed: Feb. 6, 2006

(86) PCT No.: PCT/IB2006/000216

§ 371 (c)(1),
(2), (4) Date: Aug. 1, 2008

(87) PCT Pub. No.: WO2006/120509

PCT Pub. Date: Nov. 16, 2006

(65) Prior Publication Data

US 2008/0308372 A1 Dec. 18, 2008

(30) Foreign Application Priority Data

May 13, 2005 (IT) ..... MI20050175 U

(51) Int. Cl.
*A45C 13/26* (2006.01)

(52) U.S. Cl. ..... 190/18 A; 190/115; 16/113.1

(58) Field of Classification Search ..... 190/18 A, 190/115; 16/113.1
See application file for complete search history.

(56) References Cited

U.S. PATENT DOCUMENTS 3,948,365 A 4/1976 Gregg et al.
4,256,320 A * 3/1981 Hager ..... 280/37
4,890,705 A * 1/1990 Pineda ..... 190/18 A
5,253,739 A 10/1993 King
5,291,976 A 3/1994 Ku
5,542,510 A * 8/1996 Rekuc et al. ..... 190/18 A
5,560,459 A * 10/1996 Lin ..... 190/115
5,685,402 A * 11/1997 Lin ..... 190/115
6,065,574 A 5/2000 Miyoshi
6,089,449 A * 7/2000 Butterworth ..... 231/4
6,161,253 A 12/2000 Tu

OTHER PUBLICATIONS

International Search Report of PCT/IB2006/000216, dated Jun. 20, 2006, corresponding to the present application.
Written Opinion of PCT/IB2006/000216, corresponding to the present application.
International Preliminary Report on Patentability of PCT/IB2006/000216, dated Sep. 18, 2007, corresponding to the present application.

* cited by examiner

*Primary Examiner*—Tri M Mai
(74) *Attorney, Agent, or Firm*—Abelman, Frayne & Schwab

(57) ABSTRACT

A work bag or travel suitcase with an incorporated extendable pull handle and with wheels includes a framework, having a practically parallelepiped shape and with an outer covering, in a lower portion of whose frame a supporting and containment element for a pull handle is constrained at one side having a greater length and lesser width, which is situated at the end of rod elements which can be extracted from the supporting and containment element, a pair of wheels being arranged in an opposite position with respect to the pull handle and with both the supporting and containment element and the extractable rod elements have a flattened telescopic form and are made of a light and particularly resistant material, also to shear and flexural stress. A particular pulling device which can be applied to a work bag or travel suitcase is also envisaged.

19 Claims, 9 Drawing Sheets

WORK BAG OR TRAVEL SUITCASE WITH AN INCORPORATED EXTENDABLE PULL HANDLE AND WITH WHEELS

CROSS-REFERENCE TO RELATED APPLICATIONS

This application is a 371 of international application number PCT/IB2006/000216, filed on Feb. 6, 2006.

BACKGROUND OF THE INVENTION

1. Field of the Invention

The present invention relates to a work bag or travel suitcase with an incorporated extendable pull handle and with wheels.

2. Description of the Related Art

The most widely varied solutions have been progressively studied for the easy and comfortable transporting of items and documents in the field of work bags and/or travel suitcases. These are normally associated with generally standard structures equipped with wheels and more or less extractable pulling devices.

Some of the known solutions envisage a U-shaped handle on a short side of a bag or suitcase, whose ends are inserted inside the bag or suitcase in a rest position. For use, in collaboration with a device which allows a pair of withdrawn wheels, said handle is also released and can be extracted in an extended position. An example of this kind of solution is disclosed in U.S. Pat. No. 3,917,038. This solution, however, only allows the suitcase or bag to be pulled in a tilted position and requires a complicated mechanism for the extraction or reentering rest position of the wheels and handle in the respective seats.

Other solutions such as those shown for example in U.S. Pat. Nos. 3,948,365 and 3,805,529, envisage a grip element hinged to an end side of the bag or suitcase, which can be moved from a rest position parallel to said side and a rotated and extracted pulling position of the bag or suitcase. In addition to production difficulties, this solution also has considerable encumbrance and difficulty of use.

There are also other solutions, mainly in the field of suitcases, wherein the pulling mechanism is mostly contained in the suitcase, occupying a large amount of space. These solutions are consequently not suitable for being used in a bag or the like, as the very nature of the container provides extremely limited containment space.

Furthermore, in the solutions so far adopted, the application of the grip element and wheels in the suitcase or bag distorts the overall design of their line which is therefore adapted to the presence of these auxiliary elements.

BRIEF SUMMARY OF THE INVENTION

An objective of the present invention is to provide a work bag or travel suitcase which, although equipped with a pull handle and wheels in the pulling phase, has an extremely encumbrance of said auxiliary means, at the same time however being comfortable to use.

Another main objective of the present invention is to provide a work bag or travel suitcase which, although equipped with a pull handle and wheels, maintains the original line of the bag or suitcase without any additional auxiliary element.

A further objective of the present invention is to provide a work bag or travel suitcase which above all has an extreme constructive simplicity, does not require any particular expedients in the framework of its structure or in the parts of the case occupied by the pull handle, and is easy to use.

An additional objective of the present invention is to provide a work bag or travel suitcase which can adopt a common predefined structure suitable for producing a pull handle, which is simple and sturdy.

Yet another objective of the present invention is to provide a supporting and containment element for a pull handle, i.e. a pulling device which can be applied to a work bag or travel suitcase.

These objectives according to the present invention are achieved by providing a work bag or travel suitcase as specified in claim 1.

Further constructive characteristics are disclosed in the enclosed dependent claims.

BRIEF DESCRIPTION OF THE SEVERAL VIEWS OF THE DRAWINGS

The characteristics and advantages of a work bag or travel suitcase according to the present invention will appear more evident from the following illustrative and non-limiting description, referring to the enclosed schematic drawings, in which.

DETAILED DESCRIPTION OF THE INVENTION

Figure 1:
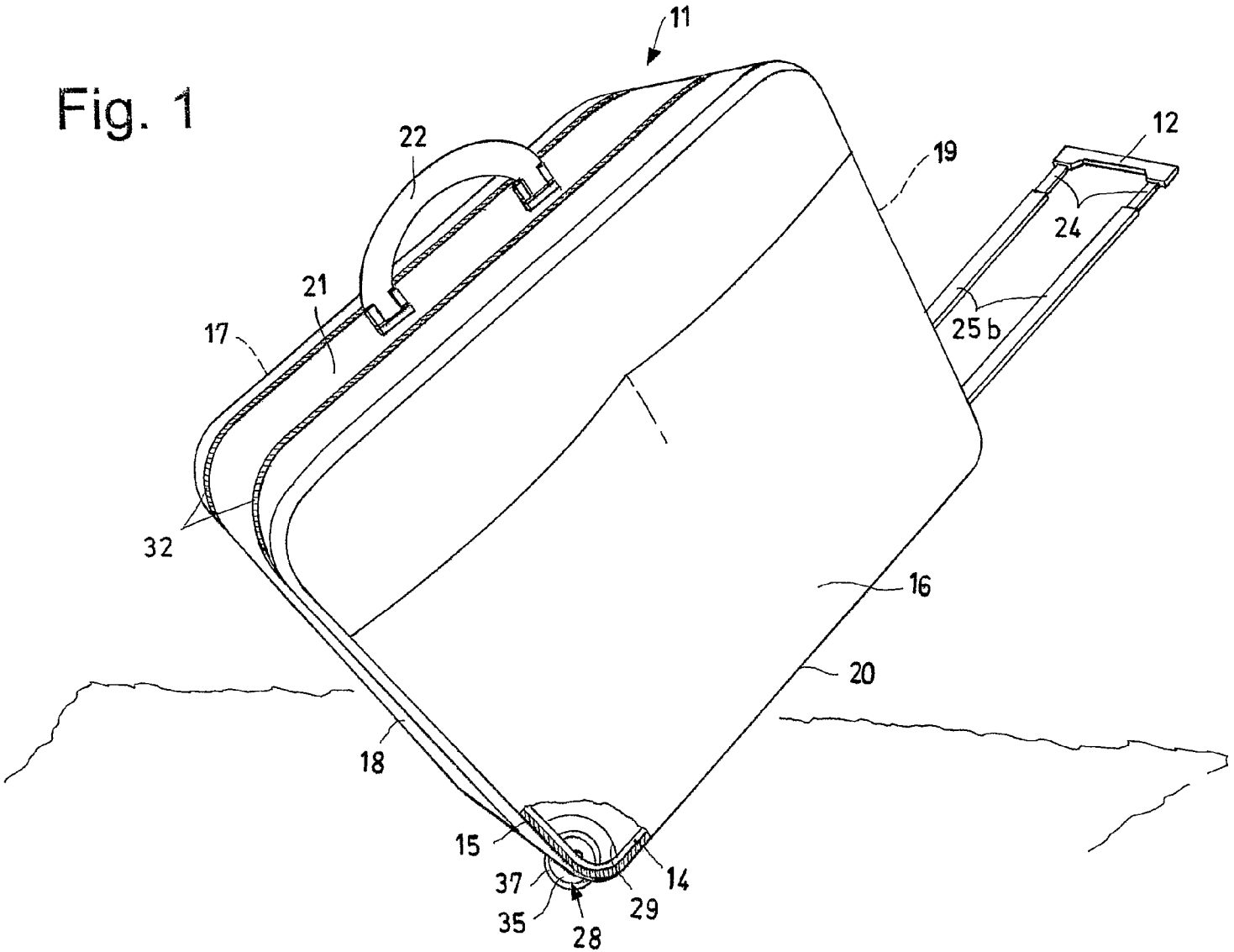
FIG. 1 is a perspective view of a bag according to the present invention in a first position for use and transportation, with the pull handle in an extracted position and a partially sectional edge.
Figure 2:
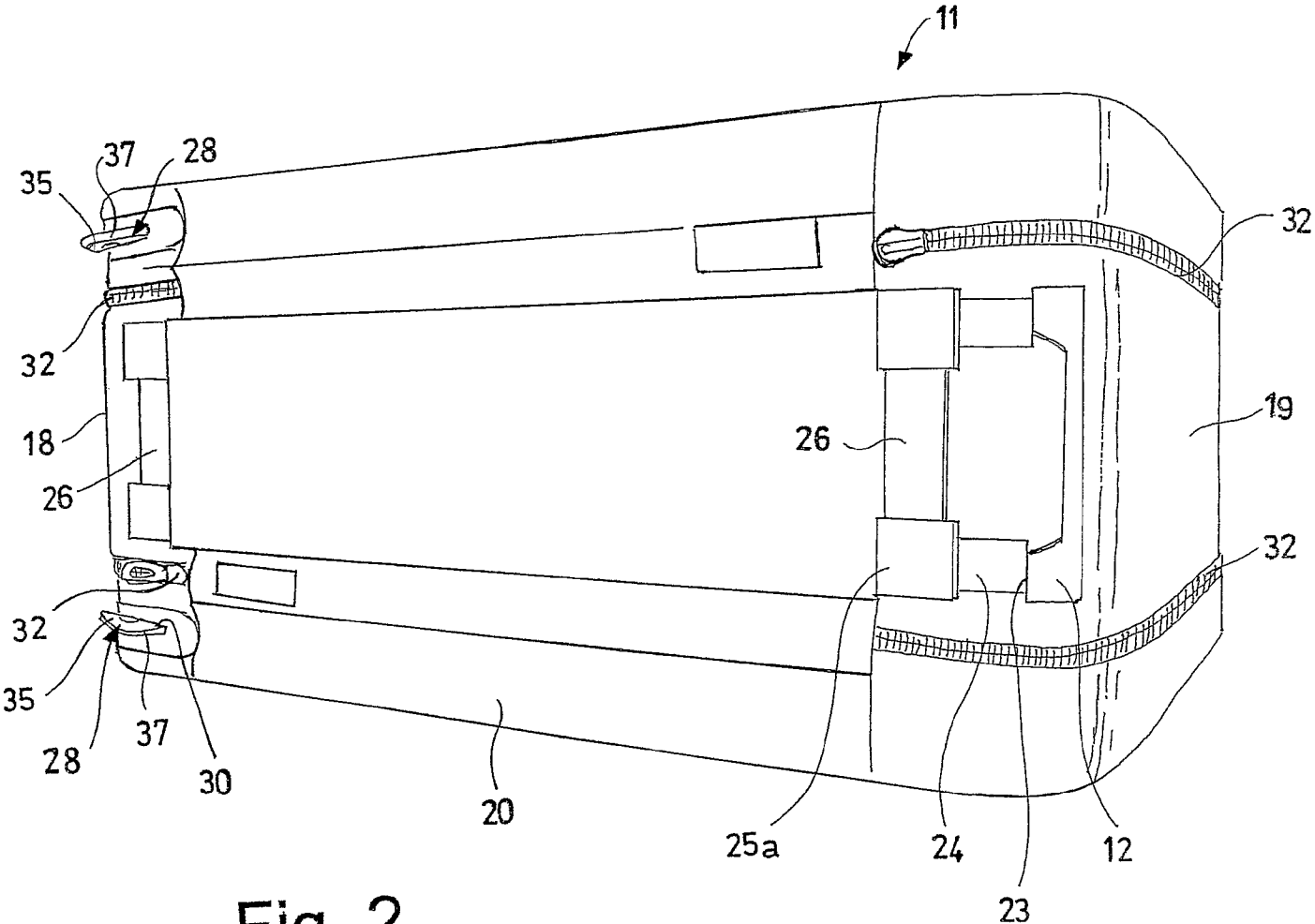
FIG. 2 is a perspective view from below of the bag of FIG. 1, with the pull handle almost completely contained inside the bag encumbrance.
Figure 3:
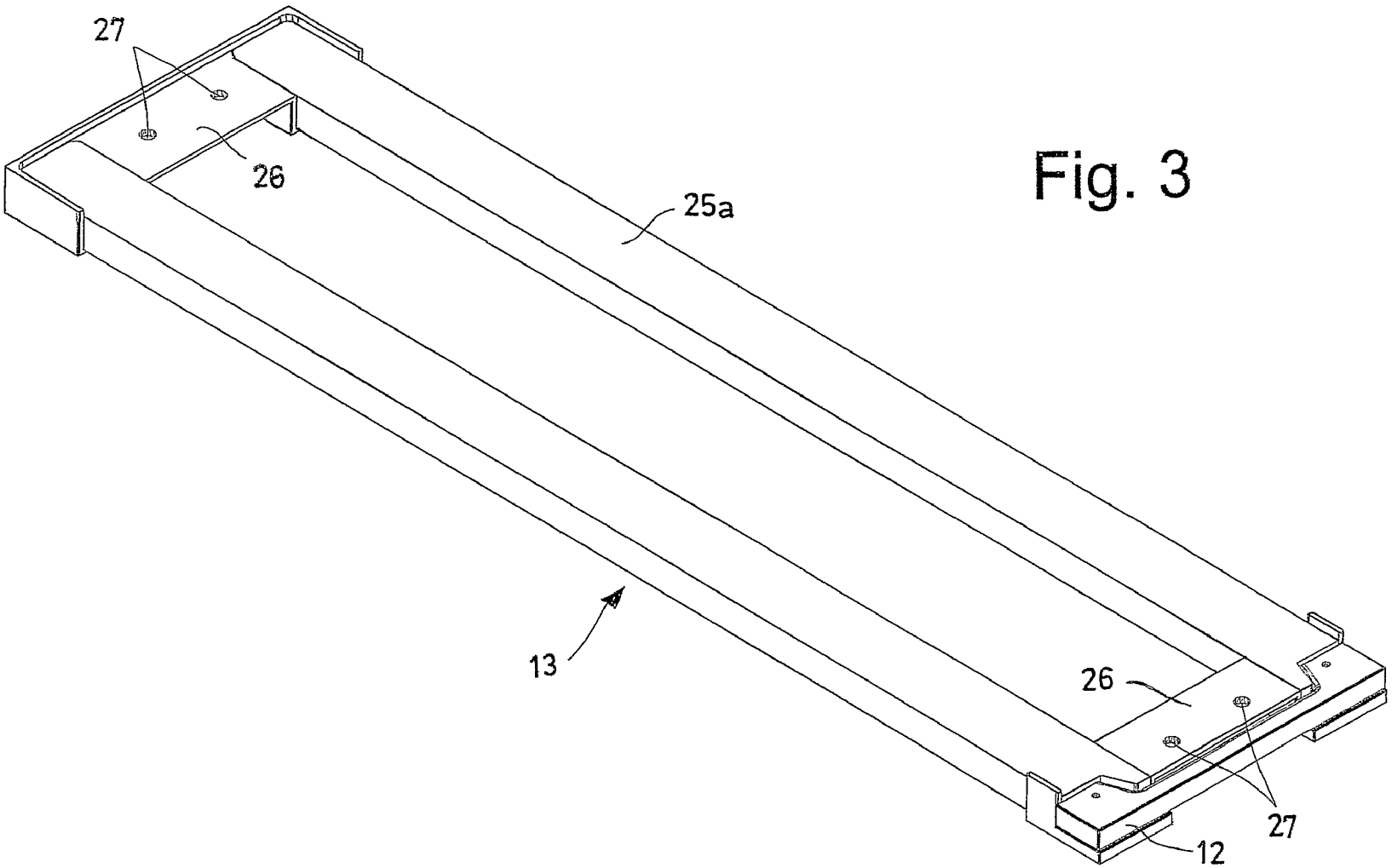
FIG. 3 is a perspective view of the supporting and containment element alone with the relative pull handle inserted therein.
Figure 4:
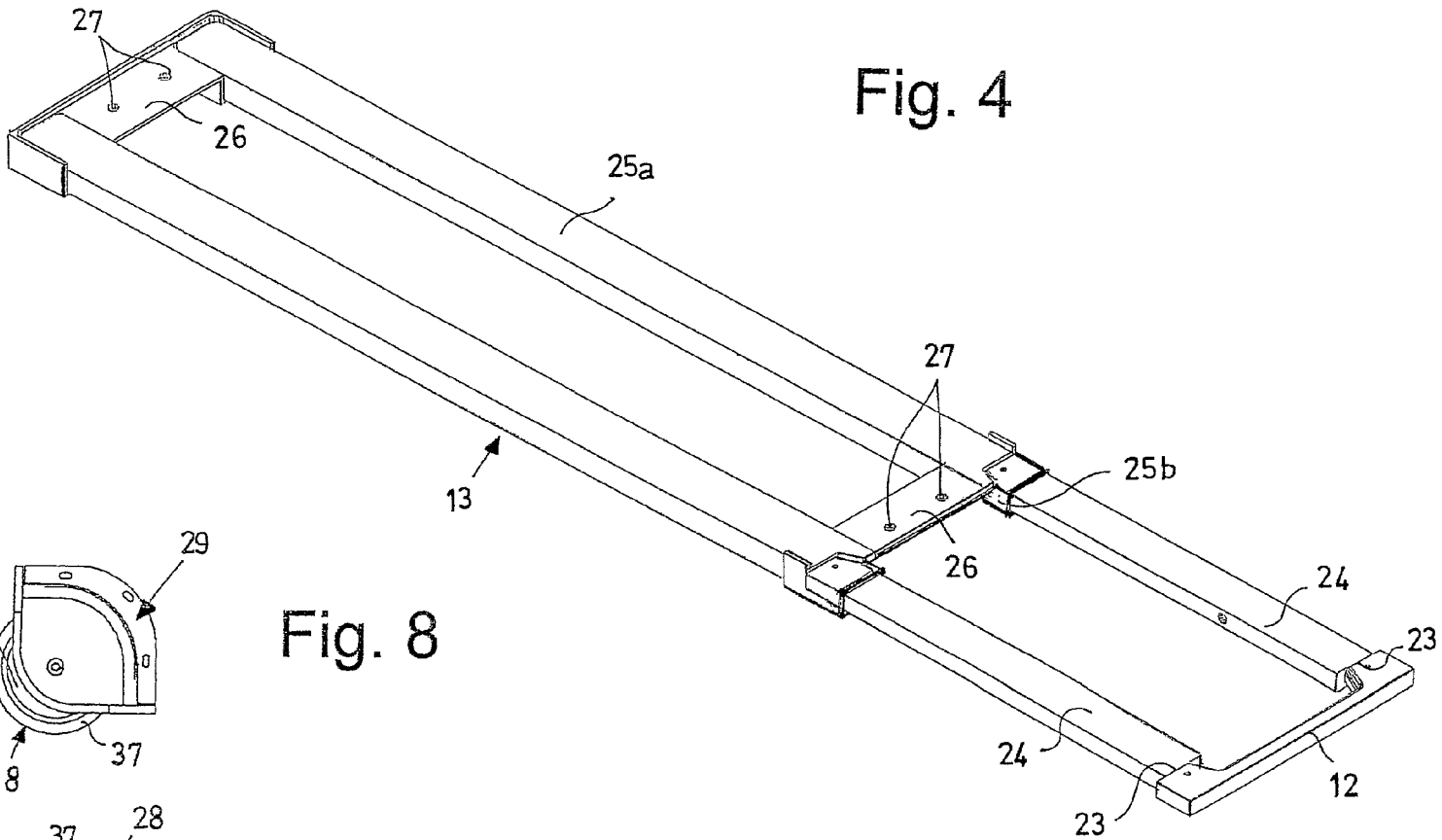
FIG. 4 is a perspective view similar to that of FIG. 3 in which the handle is partially extracted from the supporting and containment element.
Figure 8:
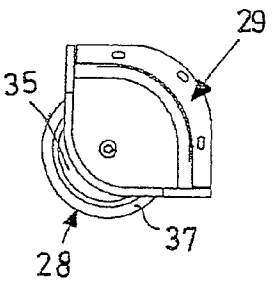
Figure 9:
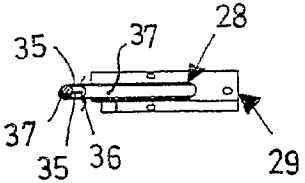

FIGS. 1 and 2 show embodiments of a travel bag 11 equipped with an extractable pull handle 12, situated inside a supporting and containment element 13 constrained to a framework 14 of the bag 11.

In general, as in the non-limiting example of the figures, the bag or suitcase has a parallelepiped shape, defined by the internal framework with an outer covering 15, made of leather or other high-quality or equivalent material.

The travel bag 11 therefore has a pair of side walls or sides having a greater width 16, 17 and a pair of side walls or heads having a limited dimension 18, 19. In addition to these side walls or sides 16-19, the bag 11 is completed by a lower wall 20 and an upper wall 21, equipped with a normal grip handle 22 for hand transportation.

Both the side heads 18 and 19 and the upper wall 21 can generally be equipped with one or more zips or similar devices 32 suitable for identifying openings for the introduction of items into the bag.

Furthermore, according to the present invention, the supporting and containment element 13 is provided for the pull handle 12.

In particular, said supporting and containment element 13 is constrained in the lower wall 20, in the side having a greater length and lesser width. In particular, the pull handle 12 is constrained to the end 23 of two flat rod elements 24, in the example with a rectangular section, which can be extracted from the supporting and containment element 13. In the example shown, the supporting and containment element 13 comprises two pairs of flat tubular elements 25*a* and 25*b*, with a rectangular section, which are inserted and move inside each other, in which the freely moving extractable rod elements 24 are inserted. The first two tubular elements 25*a* are connected by end cross-bars 26, which have holes 27 for constraining elements, such as screws, not shown, to the framework 14 of the bag 11. The second two tubular elements 25*b* are in turn inserted and move in the first two tubular elements 25*a*.

Both the second tubular elements 25*b* and the rod elements 24 envisage conical or wedge-shaped rear ends 40 and 41. Thanks to their conical configuration, said conical ends 40 and 41 block the parts between them, when in an extracted position. Said conical formation can be produced for example with portions of walls having a varying thickness. This reciprocal wedging between the parts can be subsequently disengaged by means of a light pushing action on the pull handle 12 causing the telescopic insertion of the elements inside each other.

Figure 5:
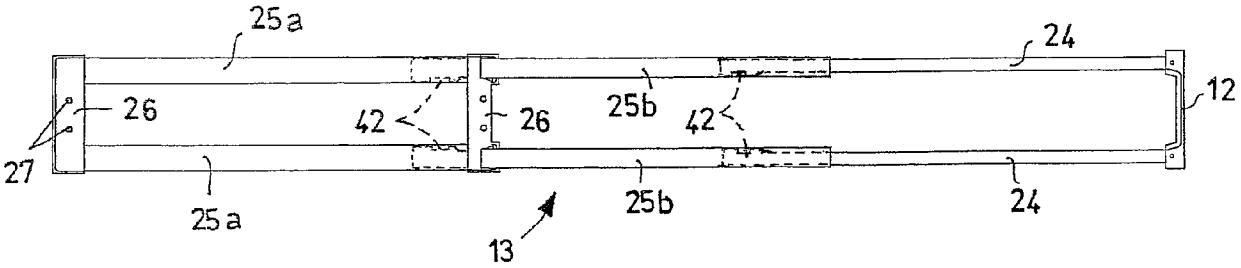
FIGS. 5 and 6 are a schematic plan view and a raised side view of the supporting and containment element with the relative pull handle extracted therefrom.
Figure 7:
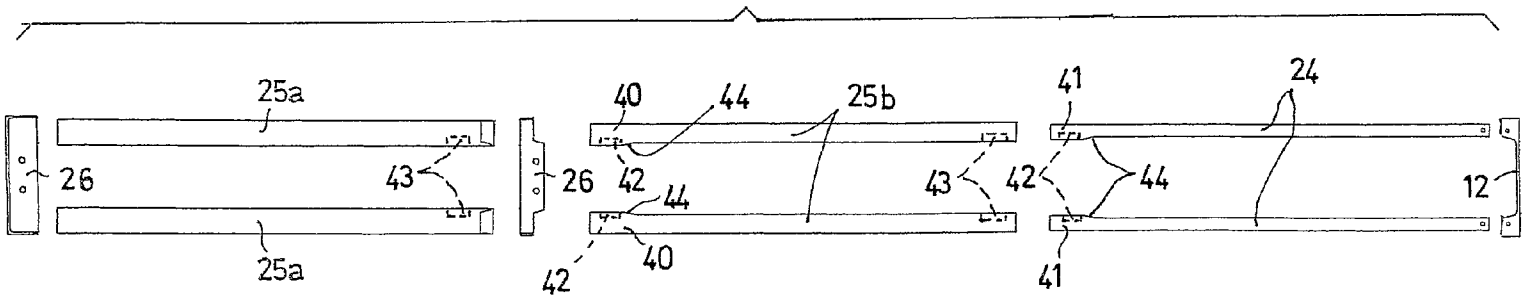
FIG. 7 is an exploded view of the parts which form what is illustrated in FIG. 3, FIGS. 8 and 9 show a plan and front view of a single wheel arranged in a specific support for application to the bag of the invention, FIGS. 10, 11 and 12 respectively show an exploded perspective view of the supporting and containment element, and two partial sections assembled in different positions of a further embodiment, FIGS. 13, 14 and 15 respectively show an exploded perspective view of a second embodiment of a supporting and containment element, and two partial sections assembled in different positions of a further embodiment.

In a particular further embodiment, in addition or as an alternative to this wedge-shaped end, magnetic elements 42 can be envisaged, indicated with the dotted-and-dashed line in FIGS. 5 and 7, which interact with metallic ends, schematized in 43 and arranged on said pairs of tubular elements 25*a* and 25*b* at outward-facing ends.

Figure 6:
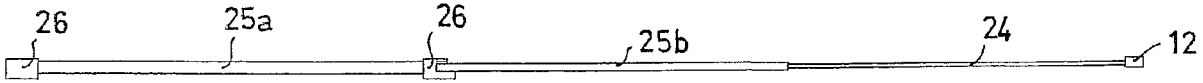

In this way, a blocking position of the elements is established in an extended position (FIGS. 5 and 6) which however can be easily disengaged for returning the various parts to a closed position by means of a pushing action.

This arrangement is obtained as a result of the processing precision of the elements in question, for example obtained by molding with extremely forced tolerances. A precise processing also produces a blockage which can be easily released with a slight pressure on the handle.

It should also be noted that the various elements of the telescopic arrangement can be inserted into each other in only one direction and cannot be extracted in the opposite direction, i.e. by pulling the handle, also due to the presence of undercuts 44 which in any case prevent their extension.

Figure 10:
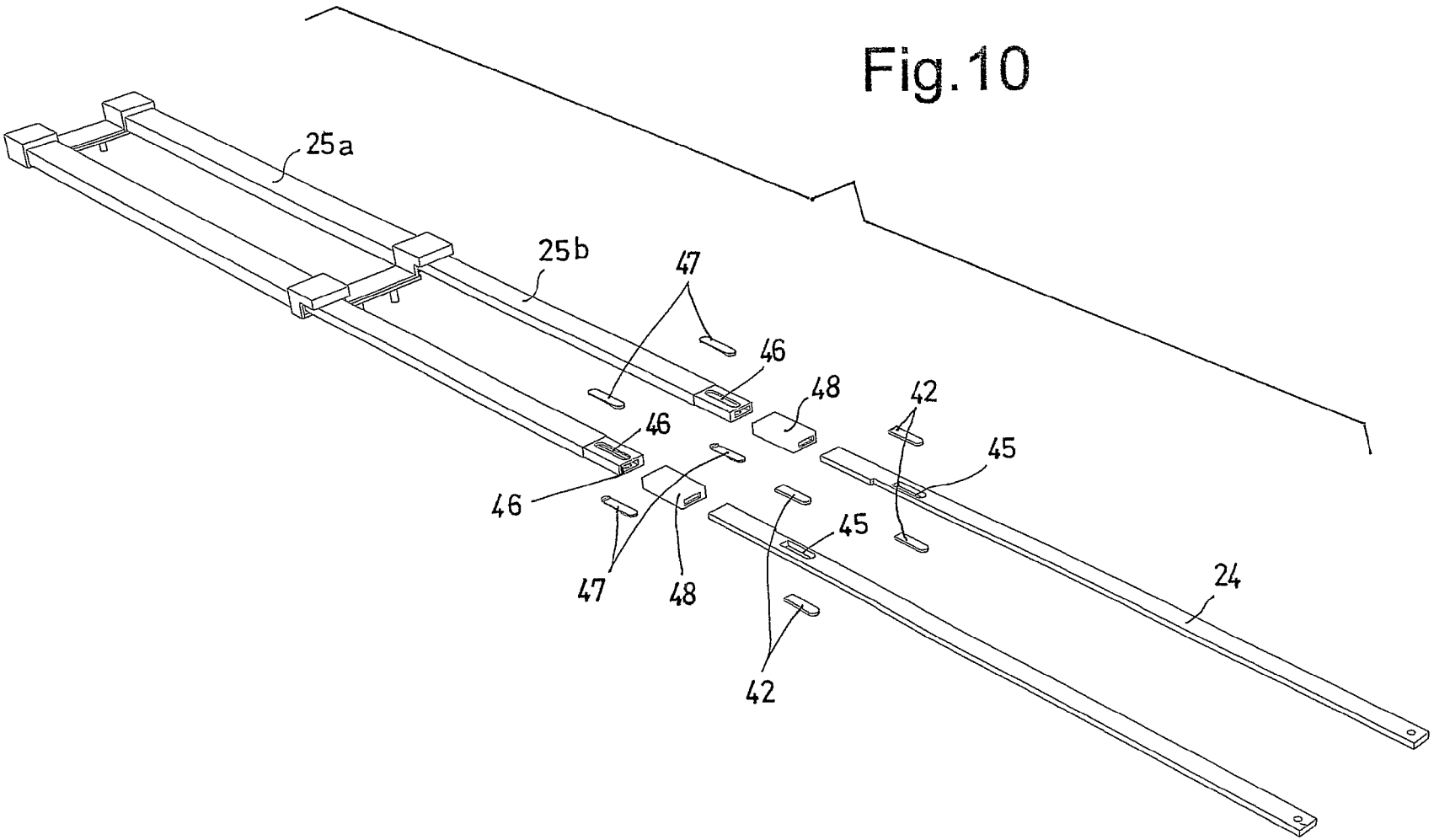
Figure 12:
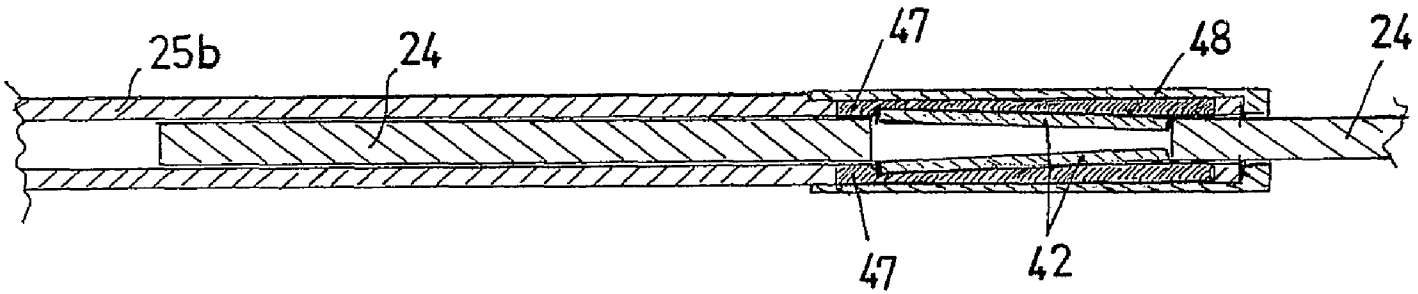
Figure 11:
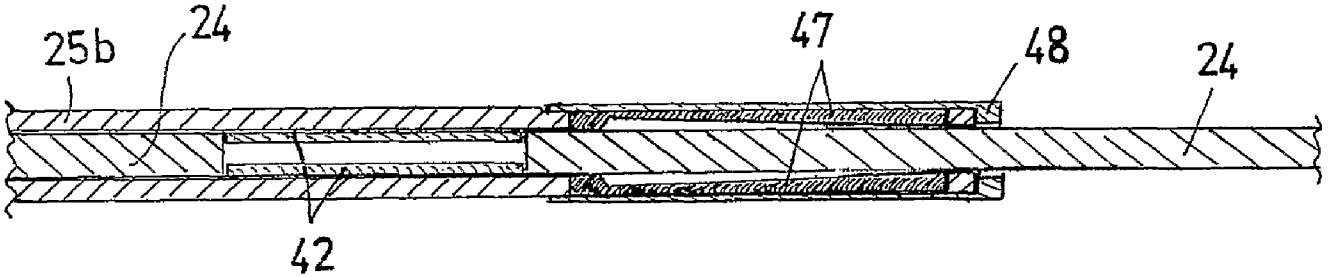

FIGS. 10, 11 and 12 show a further particularly advantageous embodiment of the arrangement of the first and second tubular elements 25*a*, 25*b* and rod elements 24. In this alternative arrangement, the second tubular elements 25*b* and the rod elements 24, both extendable with respect to the first tubular elements 25*a*, have stable reciprocal positioning elements both in a completely extracted position and in a partially extended position.

The final rod elements 24, in fact, are close to ends facing the second intermediate tubular elements 25*b* each in a seat with a pass-through slot 45. Each slotted seat 45 is suitable for receiving a pair of magnetic elements 42 whose polarities repel each other, in opposite directions outside the respective slotted seat 45.

The ends of the second tubular elements 25*b* facing the rod elements 24, each have a pair of pass-through slotted seats 46, situated in the outward-facing wall. In each of these seats 46, there is a respective plate of magnetic material 47, for example iron, with a hooked shape and profile on one side, which only partially occupies the thickness of the seat 46. A cover element 48, internally hollow, is positioned on these ends of the second tubular elements 25*b* to keep the plates in position in the respective slotted seats 46.

FIG. 11 shows the action of the magnetic elements 42 arranged in the pass-through seats 45 in a partially extracted position of the rod elements 24 from the second tubular elements 25*b*. In this position, in fact, the magnetic elements 42, which repel each other, rest on the internal surface of the second tubular elements 25*b*. Friction is generated, which is such as to keep the elements fixed in the position where they have been pulled, even if they are arranged in a vertical position, unless a pushing action is exerted thereon.

FIG. 12, on the other hand, shows how the various parts are arranged in a completely extracted position of the rod elements 24 from the second tubular elements 25*b*. In this position, in fact, the magnetic elements 42, which repel each other, at least partially protrude from their seats 45, are at least partially inserted in the seats 46 where the iron plates 47 are situated.

This insertion causes a firm blockage between the parts so that the rod elements 24 are stably extended to the maximum outside the second tubular elements 25*b*. With a minimum effort, it is possible to exert pressure on the rod elements 24, i.e. on the handle 12, disengaging the plates 47, magnetic elements 42 and respective seats 46, and allowing a return positioning of the rod elements 24 inside the second tubular elements 25*b*.

Figure 13:
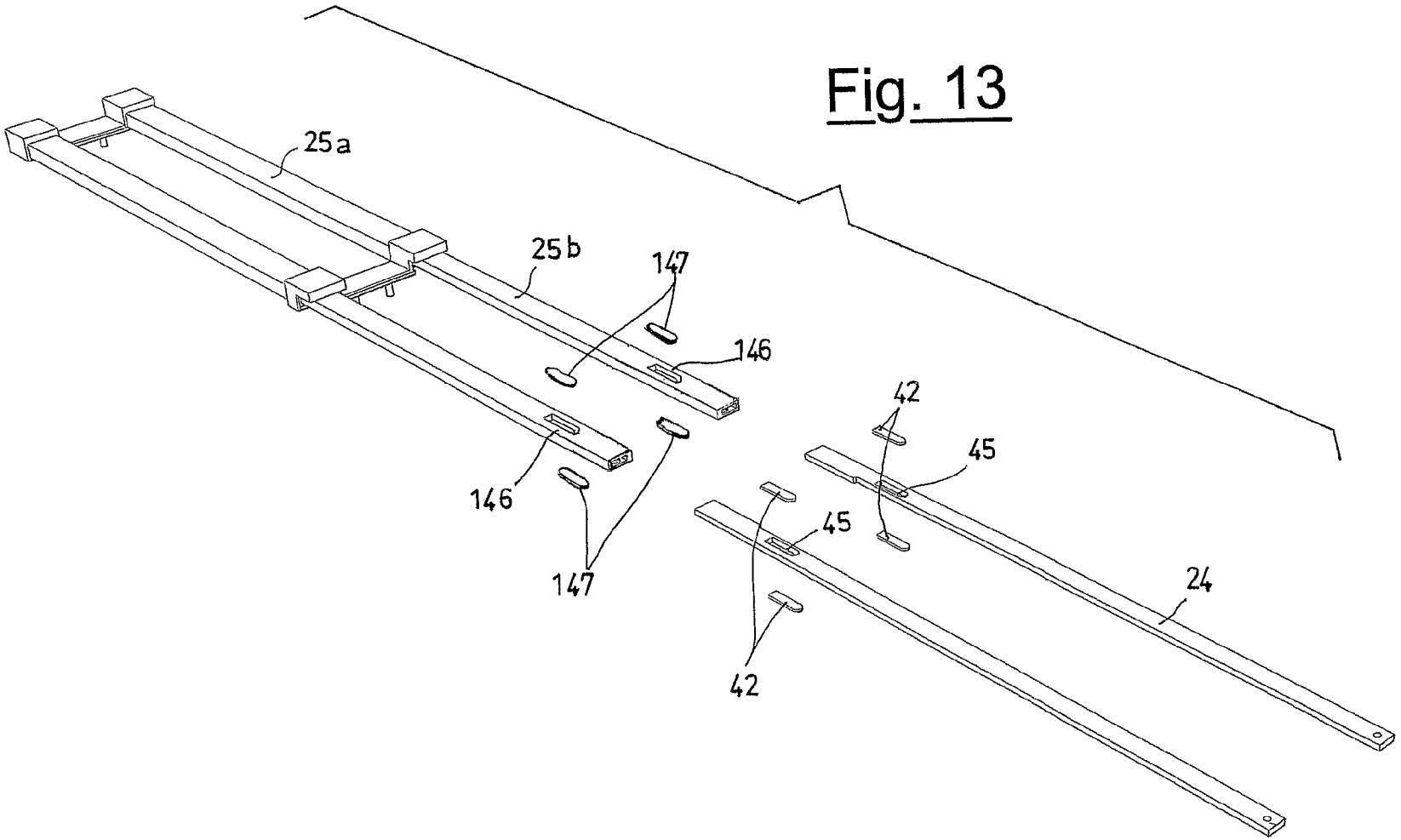
Figure 15:
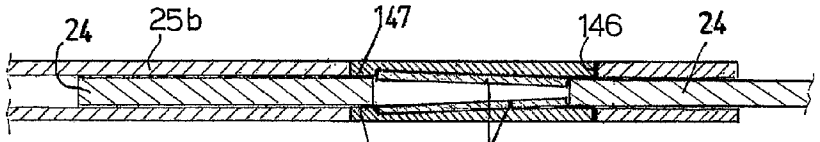
Figure 14:
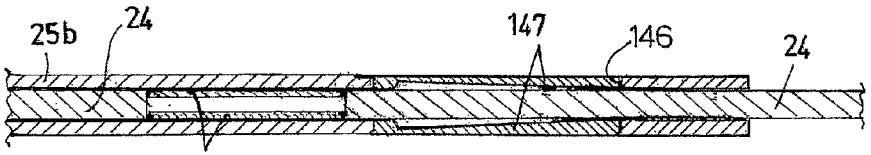

FIGS. 13, 14 and 15 show another embodiment of the arrangement of the first and second tubular elements 25*a* and 25*b* and rod elements 24 to be applied as a pulling device for a work bag or travel suitcase which, as in the previous example, has stable reciprocal positioning elements both in a completely extracted and in a partial extended position. As in the previous case, there are slotted seats 45 and magnetic elements 42.

As far as the second tubular elements 25*b* are concerned, each has a pair of pass-through slotted seats 146. In each of these seats 46, there is an integral, for example glued, iron plate 147 which only partially occupies the thickness of the seat 146.

FIGS. 14 and 15 show how the action of the magnetic elements 42 arranged in the seats 45 is equivalently exerted, generating friction as mentioned above.

FIG. 15 in particular shows how the various parts are arranged in a completely extended position of the rod elements 24 from the second tubular elements 25*b*. The magnetic elements 42, which repel each other, at least partially protrude from their seats 45, are at least partially inserted in the seats 146 where the iron plates 147 are positioned, causing blockage between the parts. The engagement and disengagement between the parts take place exactly as described above.

This arrangement is particularly safe, advantageous and simple from a construction and functioning point of view.

Furthermore, according to the invention, in correspondence with rear and lower edges, the framework 14 has a pair of wheels 28 situated inside specific supports 29 constrained thereto. The wheels 28 consist of a pair of disks 35 made of titanium, at the side of a central core 36 made of polytetrafluoroethylene, commercially available under the trademark "TEFLON", or similar material. An O-ring 37 forms the tire of said wheels, housed between the titanium disks and polytetrafluoroethylene core, commercially available under the brand name "TEFLON". In this way, thin, silent and shock-resistant wheels are obtained. In particular, the titanium disks 35 practically form an extremely hard "rim" which is not marked when descending steps, running into obstacles or hitting edges.

Figure 16:
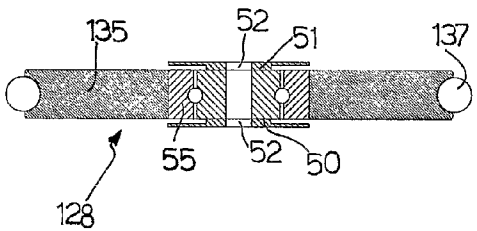
FIGS. 16 and 17 show a sectional and raised side view of a wheel arranged in a specific support for application to a bag.
Figure 17:
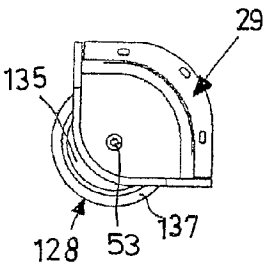

FIGS. 16 and 17 show how the wheels 128 are obtained by means of a circular centrally perforated element 135, in which a bearing or similar rolling element 55, possibly also a brass as sliding element, is positioned for interference. To the side of the bearing 55 there are two semi-flanges 50 and 51 which act as a spacer for allowing free rotation of the wheels 128 and also have seats 52 for a supporting pin 53. The wheels are made of carbon/aluminum iron alloy or the like and have a ring 137 which acts as a tread, made of a thermoplastic elastomer, or rubber, or thermosetting thermoplastic polymer which facilitates a fluid, silent and comfortable sliding movement.

The wheels 28 or 128 are slightly protruding from openings 30 situated in the outer cover 15 of the travel bag 11, in the example in the lower wall 20.

In particular, according to the present invention, both the supporting and containment element 13 and the extractable rod elements 24, not only have a flattened shape with any section, but are also made of a light, particularly resistant material, also to shear and flexural stress. This material, for example, can be a composite material, such as a laminate of carbon fiber, glass or aramidic fibers, spectra, etc. or the like.

In the example, moreover, the supporting and containment element 13 is advantageously situated outside said framework 14 and inside the outer cover 15. In this way, this auxiliary element is completely hidden and has a minimum encumbrance so that it does not disturb the overall aesthetic appearance of the work bag or travel suitcase. When in a withdrawn position, with the flattened rod elements 24 completely inside the tubular elements 25 of the supporting and containment element 13, the whole pulling group is not visible, also because it is partially enveloped by the cover.

This arrangement consequently does not disturb or limit the internal space of the work bag or travel suitcase defined by the framework 14.

FIG. 2 clearly illustrates this specific characteristic of the present invention.

FIG. 1 shows how to act when the bag must be moved not by hand transport with the gripping handle 22, but is pulled.

By acting on the pull handle 12, this is extracted from the supporting and containment element 13. This occurs because, by pulling the pull handle 12, the flattened rod elements 24 slide inside the tubular elements 25 of the supporting and containment element 13, where they were previously contained.

Consequently, by tilting the bag as shown in FIG. 1, it is possible to move it along the floor thanks to the presence of the wheels 28, pulling it with the pull handle 12. It has already been specified that although the rod elements 24 are flat, they have a particular resistance, also to shear stress, allowing a safe pulling action.

When this necessity is no longer required, the reinsertion of the rod elements 24 in the tubular elements 25 of the supporting and containment elements 13, returns the bag to the minimum encumbrance position proposed in FIG. 2. Thanks to the minimum protrusion of the wheels and arrangement of the supporting and containment element 13 in the lower part of the bag, the bag resembles a normal bag which can be used with the grip handle 22 alone, maintaining a perfect aesthetic appearance.

According to the present invention, the advantages required with respect to the known art relating to both the bag and light and functional pulling device, are therefore achieved.

The invention claimed is:

1. A work bag or travel suitcase with an incorporated extendable pull handle and with wheels comprising:

a framework, having a practically parallelepiped shape and with an outer cover, in a lower portion of whose framework a supporting and containment element for a pull handle is constrained at one side having a greater length and lesser width, which is situated at the end of rod elements which can be extracted from the supporting and containment element, and a pair of wheels arranged in an opposite position with respect to the pull handle and slightly protruding from openings situated in the outer cover in a lower wall of the bag, said supporting and containment element being situated outside said framework and inside said outer cover both the supporting and containment element and the extractable rod elements having a flattened telescopic form and being made of a light and particularly resistant material, also to shear and flexural stress, and wherein said pair of flattened tubular elements and said rod elements, both extractable, have rear ends equipped with magnetic elements for engagement in opposite ends equipped with metallic portions of said pair of fixed tubular elements and the pair of extractable tubular elements, respectively.

2. The work bag or travel suitcase according to claim 1, wherein said supporting and containment element comprises two pairs of flattened tubular elements, inserted and movable inside each other, in which said freely moving extractable elements are inserted.

3. The work bag or travel suitcase according to claim 2, wherein both said two pairs of flattened tubular elements and said rod elements have a rectangular section.

4. The work bag or travel suitcase according to claim 2, wherein said pair of flattened tubular elements and said rod elements, both extractable, are provided with conical or wedge-shaped rear ends adapted to block the parts between them when in an extracted position.

5. The work bag or travel suitcase according to claim 2, wherein both a pair of flattened tubular elements and the rod elements, both extendable with respect to the first tubular elements, have stable reciprocal positioning elements both in a completely extracted position and in a partially extended position.

6. The work bag or travel suitcase according to claim 5, wherein said releasable engagement elements in said rod elements include pass-through slotted seats which receive a pair of magnetic elements arranged with polarities which repel each other, in opposite directions outside the respective slotted seat.

7. The work bag or travel suitcase according to claim 6, wherein said releasable engagement elements in said tubular elements include a pair of pass-through slotted seats, wherein in each of said seats there is a respective shaped plate made of a magnetic material, which only partially occupies the thickness of the seat.

8. The work bag or travel suitcase according to claim 7, further comprising an internally hollow cover element, positioned on ends of the second tubular elements to keep said plates in position in the respective slotted seats.

9. The work bag or travel suitcase according to claim 1, wherein said material of said supporting element and said pull handle are made of a composite material including at least one of a laminate of carbon fiber, glass or aramidic fibers, and spectra.

10. The work bag or travel suitcase according to claim 1, further comprising, on at least one upper wall, one or more zips or similar devices suitable for defining openings.

11. The work bag or travel suitcase according to claim 1, wherein in an upper wall there is a grip handle for hand transportation.

12. The work bag or travel suitcase according to claim 1, wherein each of said wheels comprises a pair of disks made of titanium, to the side on opposite parts of a central core, an O-ring forming a tire housed between the titanium disks and the central core.

13. The work bag or travel suitcase according to claim 12, wherein said central core is made of polytetrafluoroethylene.

14. The work bag or travel suitcase according to claim 1, wherein each of said wheels comprises a centrally perforated circular element equipped with a rolling/sliding element for a supporting pin, on which an annular tread element is arranged.

15. The work bag or travel suitcase according to claim 14, wherein said wheels are made of carbon/aluminum iron alloy and said annular element is made of at least one of a thermoplastic elastomer material, rubber, and thermoplastic polymer.

16. The work bag or travel suitcase according to claim 1, wherein said wheels are arranged in specific supports constrained to a framework.

17. A pulling device which can be applied to a work bag or travel suitcase comprising:

a supporting and containment element for a pull handle which is positioned at the end of rod elements which can be extracted from said supporting and containment element which, in turn, comprises:

two pairs of flattened tubular elements, inserted and movable inside each other, in which said freely moving extractable rod elements are inserted, which form releasable engagement elements in extended positions as required with respect to each other, said supporting and containment element being adapted to be placed outside the framework of said work bag or travel suitcase and inside its outer cover characterized in that said pair of flattened tubular elements and said rod elements, both extractable, have rear ends equipped with magnetic elements for engagement in opposite ends equipped with metallic portions of said pair of fixed tubular elements and the pair of extractable tubular elements, respectively.

18. The pulling device according to claim 17, wherein said releasable engagement elements in said rod elements include pass-through slotted seats which receive a pair of magnetic elements arranged with polarities which repel each other, in opposite directions outside said respective slotted seat.

19. The pulling device according to claim 18, wherein said releasable engagement elements in said tubular elements include a pair of pass-through slotted seats, wherein in each of said seats there is a respective shaped plate made of a magnetic material, which only partially occupies the thickness of the seat.

* * * * *